United States Patent [19]

McCarney

[11] 4,395,484

[45] Jul. 26, 1983

[54] ROOMLIGHT-STABLE ULTRAVIOLET-RESPONSE PHOTOTHERMOGRAPHIC IMAGING MATERIAL

[75] Inventor: Greg J. McCarney, Hudson, Wis.

[73] Assignee: Minnesota Mining and Manufacturing Company, St. Paul, Minn.

[21] Appl. No.: 392,324

[22] Filed: Jun. 25, 1982

[51] Int. Cl.[3] ..... G03C 1/02; G03C 1/84

[52] U.S. Cl. ..... 430/620; 430/618; 430/619; 430/510; 430/517

[58] Field of Search ..... 430/618, 619, 620, 512, 430/517, 510

[56] References Cited

U.S. PATENT DOCUMENTS

| | | | |
|---|---|---|---|
| 3,764,329 | 10/1973 | Lee | 96/67 |
| 3,802,888 | 4/1974 | Willits | 96/114.1 |
| 3,988,154 | 10/1976 | Sturmer | 430/510 |
| 4,201,590 | 5/1980 | Levinson et al. | 430/517 |

*Primary Examiner*—Mary F. Downey

*Attorney, Agent, or Firm*—Cruzan Alexander; Donald M. Sell; Lorraine R. Sherman

[57] ABSTRACT

A UV sensitive dry silver photothermographic construction for graphic arts use can be freely handled for one to two minutes under cool white fluorescent lighting or incandescent lighting. The construction comprises in sequence:

a. a substrate, b. a continuous layer of a dry silver dispersion coating containing an organic silver full soap/half soap blend, a reducing agent, halide ion, and a binder resin, and c. a continuous protective topcoat layer comprising a cellulose acetate resin admixed with an effective amount of a development accelerator, said construction further comprising (1) halide ion in said silver dispersion coating or in said topcoat layer, said halide ion being at least 96 mole percent chloride ion, said halide ion when present in said dispersion coating being admixed in said dispersion subsequent to the admixing of at least a portion of said binder resin with said organic silver soap blend, and (2) an antihalation agent in any of the aforementioned layers or in a separate layer.

8 Claims, No Drawings

ROOMLIGHT-STABLE ULTRAVIOLET-RESPONSE PHOTOTHERMOGRAPHIC IMAGING MATERIAL

FIELD OF INVENTION

The present invention relates to the recording of light images using a UV sensitive, photothermographic, layered construction. In another aspect, a roomlight-stable photothermographic construction which is UV light-sensitive at ambient conditions is disclosed, the construction being useful in the graphic arts.

BACKGROUND ART

Dry silver photographic materials have been known in the art since the late 1960's. Generally the negative acting light-sensitive layer is a coating comprising a binder, an image silver source, usually an organic silver salt such as silver behenate (often referred to as silver soap), a photocatalyst such as mercury halide, and a reducing agent for silver ion.

It is believed that when the photosensitive layer is exposed to light a latent image is formed in the silver halide (which may be produced by the reaction of the silver source material with a halogen compound or it may be introduced as preformed silver halide). If the photosensitive material is visible light sensitive, the halide is preferably bromide ion.

Thereafter the silver source material can be reduced by heating in the presence of the reducing agent, this reduction being catalyzed image-wise by the silver formed on the light exposed silver halide. By a suitable choice of temperature, the reduction of the silver compound can be catalyzed in the light exposed areas to give a visible darkening while any slight reduction which occurs in the non-light exposed areas is insufficient to give a marked visible change. Other components in the layer are solvents which enable the mixture to be coated upon a substrate, dyes, development accelerators which improve the definition of the photographic image, antihalation agents, and surfactants.

Light-stable sheet materials for recording light images have been described. U.S. Pat. No. 3,802,888 relates to an light-stable sheet material which requires preheating at temperatures in the range of 210°–285° F. (99°–141° C.) to render it light-sensitive. U.S. Pat. No. 3,764,329 discloses an initially substantially light-insensitive sheet material containing an organic haloamide compound as a halogen source, the material being rendered light-sensitive by heating at temperatures in the range of 90°–143° C. These two patents refer to photothermographic systems that are essentially light insensitive until heat activated, and are then light exposed and again heated to produce an image. Essentially, these patents relate to "add-on" photothermographic systems, which are useful, for example, when new graphic intelligence is to be added to an existing microfiche card or transparency.

SUMMARY OF THE INVENTION

There is need in the art for a photothermographic material for graphic arts use that has intrinsic ultra-violet light sensitivity and roomlight handleability for short periods of time as well as having the ability to form sharp black images of high contrast. It is desirable for photothermographic constructions to be roomlight stable for 1 or 2 minutes to allow for handling of these materials during positioning, exposing, and processing in an area having incandescent or fluorescent lighting.

The present invention provides a dry silver photothermographic material for graphic arts use which can be freely handled for one to two minutes under cool white fluorescent lighting providing illumination of up to approximately 40 footcandles. Incandescent lighting or filtered lighting can enable longer handling times. This photographic material can then be ultra-violet light imaged and rapidly thermally processed to provide a sharp black image on a white background. The three separate procedures listed above, those of handling the material, exposing the material, and thermally developing the material can all be carried out in (white) roomlight conditions. Longer handling times are afforded under tungsten or yellow lighting; handling time under yellow lighting is approximately 30 minutes before significant fogging of the photographic material is encountered. The construction of the present invention overcomes the disadvantages of roomlight-handleable wet process silver halide products that require chemical and plumbing maintenance, the chemicals generally being caustic or corrosive.

The present invention provides a roomlight (incandescent and fluorescent) stable photothermographic construction which is a sheet material. The construction is UV light-sensitive at ambient conditions and is capable of forming sharp black images of high contrast. No preheating step is required to render the construction UV-responsive. The construction provided by the present invention is UV-sensitive, layered, photographic construction comprising in sequence:

a. a substrate, b. a continuous layer of a dry silver dispersion coating containing an organic silver full soap/half soap blend, a reducing agent, halide ion, and a binder resin, and c. a continuous protective topcoat layer comprising a cellulose acetate resin admixed with an effective amount of a development accelerator, said construction further comprising (1) halide ion in said silver dispersion coating or in said topcoat layer, said halide ion being at least 96 mole percent chloride ion, said halide ion when present in said dispersion coating being admixed in said dispersion subsequent to the admixing of at least a portion of said binder resin with said organic silver soap blend, and (2) an antihalation agent in any of the aforementioned layers or in a separate layer, and said construction being UV-photosensitive at ambient temperatures and roomlight stable for at least one minute and preferably two minutes at 40 foot candles (fc) of fluorescent white light.

The present invention provides a photothermographic construction having latent rather than immediate roomlight sensitivity yet having immediate UV light sensitivity, and it requires no preheating step.

In this application, the following terms are used:

"roomlight stable" means relatively insensitive to incandescent and fluorescent light at least for 1 minute without fogging;

"photothermographic" means an image is developed by heat rather than by wet processing;

"UV photosensitive at ambient conditions" means responsive to UV light without requiring preheating, useful images being obtained when the photosensitive layer is air dried;

"dwell time" means residence time of the coating dispersion in a wet state;

"full soap" means a conversion of essentially 95 weight percent of a long chain fatty acid to its organic silver salt, such as silver behenate or silver stearate, or mixtures thereof; and "half soap" means an essentially equimolar blend of an organic silver salt with its corresponding fatty acid, such as silver behenate and behenic acid.

DETAILED DESCRIPTION

The present invention provides a photothermographic layered construction that has intrinsic ultraviolet light sensitivity and latent roomlight sensitivity due to critical components in the various layers and critical procedures employed in the preparation of the construction. Surprisingly, this material does not require a pre-exposure photosensitization step; rather, it has intrinsic light sensitivity at all times.

The present invention provides a thermophotographic layered construction comprising:

a. a transparent or opaque substrate, b. coated upon one surface of said substrate, a continuous layer of a dry silver emulsion coating, said coating comprising:

1. a blend of organic silver full soap and half soap to provide in said layer a weight ratio of total silver in the coating to silver soap in the range of 1:7 to 1:4.2, preferably 1:6 to 1:4.6, and 2. a polyvinyl acetal resin, said resin to silver soap weight ratio being in the range of 0.6:1 to 2:1, and c. a protective/reactive topcoat layer comprising a cellulose acetate resin admixed with a development accelerator which preferably is phthalazinone or phthalazine and 4-methyl phthalic acid, the latter being known in the art and is described in U.S. Pat. No. 4,123,282, said construction further comprising:

d. 0.5 to 20 mole percent of halide ion compared to silver in said silver coating or said topcoat layer, at least 96 mole percent of said halide ion being chloride ion, and e. an effective amount of an antihalation agent incorporated in any of layers a., b., or c., or in a separate layer between said substrate and said silver coating layer, said construction being intrinsically ultraviolet light-responsive and roomlight stable for at least one minute or longer when exposed to fluoroscent or incandescent lighting, and capable of forming graphic arts images having a contrast of at least 2.5, preferably at least 3.0.

The UV light sensitive, heat-developable layer contains photosensitive silver halide which is at least 96 mole percent silver chloride, an organic silver salt, and a reducing agent in a suitable binder. Chloride-containing compounds are useful in the present invention since the sensitivity of silver chloride is restricted primarily to the ultraviolet light region. The introduction of bromide or iodide in any significant amount (i.e., greater than 4 percent) defeats the roomlight handling characteristics because their respective silver halides are sensitive into the blue and blue-green portions of the visible light spectrum. Exposure to a UV light image generates from the silver chloride component a latent image which catalyzes the image-forming reaction between the silver soap and reducing agent to make possible the heat development of the visible image. The UV photosensitive silver chloride is formed by reaction of a source of chloride ions with a small proportion of the organic silver salt. The present invention provides a concentration of chloride ions of about 0.5 to 20 mole percent compared to silver and preferably 1.0 to 5.0 mole percent. Up to 4 mole percent of the halide present in the layer may be bromide ion or iodide ion without substantially increasing the resulting fogging of the sheet material during a 1 to 2 minute roomlight exposure. Silver halide sensitizing dyes are to be avoided.

Halidization can be carried out in a number of ways. Chloride-containing compounds which readily react with silver nitrate solution are suitable. Any ionic chloride, such as the chloride salt of alkali and alkaline earth metals, nickel, iron, zinc, or cobalt is useful, although a solution of mercuric chloride in methanol is preferred since mercuric ion increases the whiteness of the layer and inhibits fog production upon exposure to visible light. The halidization can be effected by adding small quantities of the chloride-containing compound to the silver dispersion following the addition of a significant portion of the resin binder. Alternatively, the chloride compound can be added to the protective topcoat layer, which is applied after the silver dispersion has been coated and dried. The addition of preformed silver chloride to the organic silver salt can also be carried out, achieving essentially the same results and photographic utility as in the in-situ formation described above. As mentioned above, the chloride ion provides the sensitivity of the layer primarily in the ultraviolet portion of the spectrum. Severely limiting bromide and iodide ions present in the layer accounts in part for the roomlight stable properties of the construction.

The type and ratios of silver soaps used in the photosensitive layer of the present invention are important. For graphic arts applications, high contrast can be beneficial as an aid to sharpness. The information to be photographically recorded is generally black on white images. For this reason, it is advantageous to utilize blends of full and half silver soaps to achieve improved sensitometry. Silver half soap tends to be more stable chemically, offering better post-processing stability in white background areas of the unfixed silver salt coating, but results in greater haziness (increased halation) and significantly lower contrast than full soaps. Full soaps can produce higher contrast images, but are more subject to yellow fog and background instability than half soaps. It has been found that blending of these silver full and half soaps produces distinct improvements in the total photographic utility for the dry silver process. High contrast black on white images with good background whiteness retention are possible with this approach. Depending on the developer/toner combination selected, gamma values (contrast) of six (6) or higher can be achieved. Preferably, the organic silver salt is a blend of silver behenate, silver stearate, behenic acid and stearic acid, the total silver to silver soap weight ratio in the silver coating being in the range of about 1:7 to 1:4.2, and preferably the range is 1:6 to 1:4.6. Using only half soap provides a silver:silver soap ratio of 1:7.3 and using only full soap provides a silver:silver soap ratio of 1:4.2. It is believed that the use of these blends, in the silver to silver soap ratios disclosed herein, represents a new and extremely useful aspect of the present invention.

Another aspect in providing reduced sensitivity in the photothermographic sheet material is the admixture of at least a portion of polyvinylacetal resin with the silver soap prior to addition of chloride (halidizing) compounds. In particular, the combination of 5 percent; and preferably 10 percent by weight of a polyvinylbutyral resin with the silver soap prior to the halidization of the silver reduces the photographic sensitivity of the subsequently formed silver chloride. It is believed this is due to a reduction in the grain size and modification of the size distribution of the silver halide formed. It has been found that polyvinylbutyral resin adheres very strongly to silver halide grains, which may present a steric barrier to grain growth.

Although proportions of polyvinylbutyral resin and silver soap similar to those cited in U.S. Pat. No. 3,802,888 may be used, a surprising result is that immediate formation of light sensitive silver halide takes place in the present invention, and no heat-induced reaction between silver soap and halide is required to render it photosensitive. The addition of all of the polyvinylbutyral resin, which is incorporated as the resin binder, has the effect of significantly reducing photographic sensitivity but not, as in the case of U.S. Pat. No. 3,802,888, preventing reaction of the halide ion and the organic silver salt. All of the resin need not be admixed with the silver soap, however, and in fact, in the range of 5 to 10 weight percent of the total, resin i.e., 0.3 to 0.6 grams of resin per gram of silver (when the total resin to silver soap weight ratio is 1.26:1), added prior to the halide ensures significantly reduced photographic sensitivity. All or part of the polyvinylbutyral resin can be added to the silver soap prior to halidization, as long as its quantity is sufficient to significantly attenuate photosensitivity. An example of this effect is demonstrated in Example 10 below.

The residence time of the wet silver dispersion is not critical in the present invention. The dispersion can be coated immediately upon the addition of halide or 24 hours or more later with essentially the same good results. It is preferred that the chloride compound be added to the wet silver dispersion, although the chloride compound can be present in the topcoat layer.

Reducing agents which are known in the art of photothermographic materials and are useful in the present invention include substituted and unsubstituted bisphenols, naphthols, aminophenols, sulfonamidophenols, catechols, pyrogallols, di- or polyhydroxybenzenes, ascorbic acid, phenidone, metol, and hydroquinone ethers.

Reducing agents for silver ion of the hindered phenolic types are particularly useful for inclusion in the photosensitive layer because they exhibit good shelf stability, maintain a strong reduction differential in light struck vs. non-light struck areas, and are soluble in the solvents used. Suitable reducing agents, present in an amount of 0.1 or higher, preferably in a range of 0.1 mole to 0.8 moles reducing agent per mole silver, include:

2,2'-methylenebis-(4-methyl-6-tertiarybutyl phenol)
2,2'-methylenebis-(4-ethyl-6-tertiarybutyl phenol)
1,1-di(2,4-dimethyl phenol)-3-methyl-5,5-dimethylhexane
2,6-methylene-bis(2-hydroxy-3-tertiary-5-methylphenyl)-4-methylphenol Coatings of the photothermographic layer compositions may be made on a temporary support and removed therefrom in dry thin film form, but will ordinarily be applied to a substrate, such as glass, transparent films, opaque films such as titanium dioxide pigmented polyester film, paper, fabric, and metal foils, which form a part of the final sheet product. The substrate may be primed or subbed for improved bonding or to prevent excessive penetration or for other purposes, and the coating may be further protected with additional surface layers if desired. Transparent coatings on transparent film backings or supports are particularly desirable in permitting subsequent copying of data from the imaged sheet by methods involving light projection or contact printing onto a photosensitive receptor.

The construction of the present invention includes an antihalation agent which may be present in any layer or in a separate layer between the substrate and the UV-sensitive layer. Such an agent limits light scattering by absorbing incident and reflected light. Suitable antihalation agents can include ultraviolet light-absorbing coating surfaces, UV absorbing organic binders, and ultraviolet light-absorbing compounds and dyes, which are well known to those skilled in the art. It has been found that rutile titanium dioxide is a particularly useful antihalation component, and preferably it is present in the substrate or a resin layer above the substrate in sufficient quantity to control light scatter. Useful amounts of titanium dioxide are, for example, 8 weight percent in a 2 mil (51 micron) thick polyester substrate and 12 to 15 weight percent in a 1 mil (25 micron) thick resin coating on paper. This white pigment can be alternatively included in the construction as by addition to the substrate (i.e., addition to paper fibers or paper sizing), as a solvent or aqueous overcoat, an an addition to a hot melt plastic extrusion coating, or as an addition to a radiation cured coating mixture.

Titanium dioxide is routinely utilized in photographic RC papers for its properties of providing whiteness and high opacity to the resin coating. Also, it reduces light scattering from the coating surface, thus improving photographic sharpness. In this application, however, use is made of the strong ultraviolet absorbance of titanium dioxide, this property making it an excellent antihalation agent. Titanium dioxide, when properly selected as to grade, surface treatment, and method of incorporation, is non-reactive with the other components of the present construction. For paper applications, titanium dioxide is preferably matrixed in a resin or plastic coating over the paper. The $TiO_2$-containing layer prevents the silver coating from penetrating into paper fibers. In the case of transparent substrates, a transparent UV absorbing agent in the silver coating, topcoat, substrate or in a clear underside coating is preferred. Also, ultraviolet absorbing dyes can be incorporated in the antihalation layer in addition to titanium dioxide, to provide further sharpening of the image, to further reduce sensitivity, or both.

Development accelerators, sometimes referred to as image 'toners', are a component of this photothermographic construction. Such a development accelerator is conveniently incorporated in a protective topcoat, although it also functions when added to the silver dispersion. Development accelerators aid the relatively weak developing (reducing) agents to produce a dense black image at the thermal development conditions utilized. Various types of development accelerators are known in the art; a partial list includes: phthalazinone, see U.S. Pat. No. 3,080,254; imidazole and phthalic acid compounds, see U.S. Pat. No. 3,847,612; phthalimide, see Belgium Pat. No. 766,590; N-hydroxyphthalimide, see U.S. Pat. No. 3,782,941; substituted phthalazinone, U.S. Pat. No. 3,844,797; and phthalazine and a phthalic acid compound, see U.S. Pat. No. 4,123,282. Phthalazinone by itself, or phthalazine and 4-methylphthalic acid in combination are preferred development accelerators in the present invention.

Illumination sources for the construction of the present invention include special phosphor fluorescent tubes or cathode ray tube screens, xenon lamps, mercury vapor lamps, carbon arc lamps, ultraviolet output lasers, and the like.

In addition to the essential components described above, the coatings of the invention may contain additional components such as wetting agents, dispersing aids, antifoggants, flatting agents, light bleachable dyes for registration of where previous exposures have been made, adhesion promoting agents, tinting dyes, pigments, bleachable filter dyes to extend roomlight handling time, antifoam agents, fillers, etc.

It is surprising that the construction requires no preheating step to sensitize the UV light-sensitive layer. No preheating is required, and indeed, images of commercial quality are achieved without preheating. However, oven drying does serve to improve the sensitivity and the image quality of the construction, by minimizing water vapor absorption from the air by the solvents contained in the coating dispersions. In commercial production oven-drying of the layer may be preferred to speed up the drying step, and air temperatures up to 96° C. (205° F.), and preferably up to 93° C. (200° F.) are suitably employed. The roomlight stable property of the construction of the present invention is derived from very low chloride concentrations, 1 to 5 mole percent relative to silver present, and the admixture of at least a portion of the polyvinyl butyral and the organic silver salt prior to the addition of halide ion.

The construction of the present invention is useful as a graphic arts material, for example as a product for headline and manual text-type typesetters and contact printing of text type, halftone reproductions, or other photographic recording where the operator desires a photographic material that he can handle for a short period of time without a photographic darkroom. It should be emphasized that the subject of this invention is not of the "add-on" type; rather, it is ultraviolet light-sensitive from the time it is halidized during preparation or coating.

Objects and advantages of this invention are further illustrated by the following examples, but the particular materials and amounts thereof recited in these examples, as well as other conditions and details, should not be construed to unduly limit this invention.

The temperature of oven drying for all examples listed below is lower than the temperature range for preheat sensitization in U.S. Pat. No. 3,802,888, which discloses photo-sensitizing temperatures of 99° C. to 141° C.

EXAMPLE 1

A procedure for preparing the photothermographic construction according to the present invention is as follows:

A mixture of homogenized silver soaps and toluene was agitated in a glass vessel. The silver to silver soap ratio was approximately 1:5 (by weight). Polyvinylbutyral resin B-76 (Monsanto Chemical Co.) was added and mixed until dissolved (resin to silver soap ratio was 1:34:1 by weight). Mercuric acetate, an antifoggant, was then added followed by the addition of the developer, 2,2'-methylene-bis-(4-methyl-6-tertiarybutyl phenol) (CAO-5 Antioxidant, Sherwin Williams Chemicals). Finally, mercuric chloride, as source of chloride ions was added from a methanol solution. The chloride level was sufficient to halidize 1.5 percent of the calculated silver available. The components and amounts used was as follows:

| | |
|---|---|
| full soap (12.2% solids) | 90 g |
| half soap (15.5% solids) | 30 g |
| toluene | 55 g |
| B-76 resin | 21 g |
| mercuric acetate in methanol (4.5%) | 2 cc |
| 2,2'-methylenebis-(4-methyl-6-tertiarybutyl phenol) | 3 g |
| mercuric chloride in methanol (3%) | 2 cc |

The batch was mixed for 10 minutes after the addition of mercuric chloride, and then promptly coated at a four mil (102 micron) orifice with a knife coater, to provide a dry coating weight of approximately 0.12 grams/square decimeter. The coating substrate was white polyester, the opacity derived from 8 weight percent loading of rutile titanium dioxide. The coating was dried for 3.5 minutes at 74° C. in a Blue M oven (Blue M Manufacturing Co.) modified to contain a continuous web drying system.

A reactive/protective topcoat was then applied over the first coating containing 4.6 parts by total weight Eastman cellulose acetate 398-6 resin in a blend of ketones, methanol, and methyl-cellosolve. This coating also contained dispersed silica and 2.4 percent by weight phthalazinone. The components and parts by weight used was as follows:

| | |
|---|---|
| acetone | 62.25 |
| methyl ethyl ketone | 12 |
| methanol | 9.5 |
| methyl cellosolve | 3 |
| cellulose acetate 398-6 | 4.2 |
| silica premix | 8 |

The topcoat was applied over the silver dispersion coating at 3.5 mil (89 micron) orifice and was oven dried in the same fashion as described for the first coating.

The substrate thus coated was tested for sensitometry with a Model 261 Diazo Printer (3M) equipped with a mercury halide lamp and a 0–4 continuous density sensitiometric wedge. The UV exposure was carried out at maximum lamp intensity for 20 seconds. Following exposure, samples were developed with a hot roll processor, featuring a fiber roller rotating in near-contact within the arc of curvature of a resistive heatinng element for several seconds at 135° C.

Alternatively, the phthalazinone can be contained in the silver dispersion, at a level of 2.4 weight percent in this example, and removed entirely from the reactive/-protective topcoat.

As another alternative, the formulation can contain, instead of phthalazinone, a combination of phthalazine and 4-methylphthalic acid. THe phthalazine and 4-methylphthalic acid are preferably added to the topcoat which is then coated, dried, exposed, and processed as described above.

The sensitometric wedges of the three constructions described above were plotted and analyzed by a computer-assisted scanning densitometer. The sensitometry data is shown in TABLE I.

TABLE I

| Sample | Processing | Dmin | Dmax | γ** | Speed point* |
|---|---|---|---|---|---|
| Phthalazinone in topcoat | 3 sec. at 135° C. | .15 | 2.02 | 6.04 | 2.10 |
| Phthalazinone in silver coating | 4 sec. at 135° C. | .15 | 2.03 | 6.2 | 2.11 |
| Phthalazine and 4-methyl-phthalic acid in topcoat | 4 sec. at 135° C. | .06 | 1.70 | 3.74 | 2.57 |

*Speed point, as used in all Examples, is the log exposure value at a density of 0.6 over fog level. It measures the amount of energy necessary to achieve a predetermined photo density. The lower the speed point, the faster is the photographic sensitivity.

**γ is a measure of contrast and is defined as the tangent of the angle formed between the rising straight line portion of the D log E curve and the baseline (Log Exposure is the abscissa). As contrast (rate of density increase per unit exposure increase) increases, the value of γ becomes larger.

The data of TABLE I show the basic sensitometric performance achievable with either of two development accelerators, phthalazinone or phthalazine/4-methylphthalic acid. The use of phthalazinone not only results in higher contrast or density, but also greater speed, with increases in $D_{min}$ and light sensitivity.

EXAMPLE 2 a. No preheating; use of soap blend

A dispersion of homogenized silver soap, 9.5 percent by weight in toluene and methyl ethyl ketone, plus a small amount of a dispersing agent, were agitated in a glass vessel. Polyvinyl butyral resin B-76 was added at a level of 1.26 grams resin/gram silver soap, and the batch was mixed until dissolved. Mercuric acetate, an antifoggant, was added at a level of 0.045 weight percent of the total batch from a 4.5 percent by volume methanol solution. A reducing agent, 2,2'-methylenebis-4-methyl-6-tertiary-butyl phenol was added at 1.25 weight percent of total batch weight. Mercuric chloride was added at 0.02 weight percent of the total batch, and after this addition mixing was continued for only one minute to insure only a very brief residence time of chloride ion and silver ion. The dispersion was immediately coated onto a titanium dioxide loaded polyester sheet and dried at room temperature for 12 minutes. Following this, a protective/reactive topcoat containing phthalazine and 4-methylphthalic acid, as described in Example No. 1, was applied, the construction being again air dried for 12 minutes.

A second identical silver dispersion and topcoat were prepared, but this time each coating was dried for 3.5 minutes at 74° C. Again, the mercuric chloride was added to the silver dispersion, mixed for one minute, and then immediately coated.

The two coated samples were UV exposed on a Model 261 diazo printer utilizing a mercury halide lamp for 25 seconds at maximum intensity through a 0–4 continuous density wedge.

The exposed samples were processed with a computer assisted scanning densitometer, yielding the following data on developed density and sensitivity:

TABLE IIA

| Sample | Processing | Dmax | Speed point |
|---|---|---|---|
| Air dried | 3.5 sec., 135° C. | 1.28* | 3.42 |
| Oven dried (74° C.) | 3.5 sec., 135° C. | 1.72 | 2.71 |

*Actual Dmax attainable was over 1.5, but image break-up due to blush (water vapor absorption) in the area read by the densiometer resulted in lower figure.

The data in TABLE II A show that even with a very short residence time and no preheating of any kind, intrinsic ultraviolet light sensitivity was present in constructions within the present invention.

b. Preheating; use of full soap

Very short residence time of the halide and silver soap and preheating were tested with a full soap (silver behenate, silver stearate homogenized in methyl ethyl ketone).

A full soap homogenate was mixed with toluene, and polyvinylbutyral resin B-76 was added at a level of 1.43 grams resin per gram of silver soap. Mercuric acetate was added in an amount of 7.7 mg per gram of silver soap. The developer, 2,2'-methylenebis-(4-methyl-6-tertiarybutyl phenol) was added at a level of 0.2 grams developer per gram silver soap. Mercuric halide was added in sufficient quantity to halidize 1.8 percent of the available silver on a mole basis.

The addition of mercuric chloride was followed by only 10 seconds of agitation, and was then immediately coated, thus sharply limiting residence time of halide and silver soap. The silver dispersion was coated at 4 mils (102 micron) wet orifice, and dried for 3.5 min. at 74° C. The topcoat was as described previously in Example 2, and was coated at 3.5 mils and dried for 3.5 min. at 74° C. The substrate coated was a titanium dioxide loaded polyester film.

The coated material was exposed for 20 seconds through a 0–4 continuous wedge on a Model 261 diazo printer, utilizing a mercury halide lamp. Samples were also preheated before exposure for 2 seconds at 135° C. to test for any heat-induced sensitization. Results are indicated below in TABLE II B.

TABLE IIB

| Sample | Condition | Processing | Dmin | Dmax | | Speed Point |
|---|---|---|---|---|---|---|
| Full Soap 10 sec. mixing | No Preheating | 2.5 sec. 135° C. | .09 | 1.9 | 4.65 | 2.71 |
| Full Soap 10 sec. mixing | Preheated 2 sec., 135° C. | 2.5 sec. 135° C. | .11 | 1.62 | 2.58 | 3.2 |

The data of TABLE II B show that preheating did not induce greater photosensitivity, but instead, reduced the sensitivity of the coated sheet material.

EXAMPLE 3

The useful range of AgCl in the silver dispersion was tested over a wide range of concentrations.

Homogenized silver soap, dispersed in toluene and methyl ethyl ketone, was agitated in a glass vessel. Polyvinylbutyral B-76 resin was added at a rate of 1.26 grams resin/gram silver soap. After the resin was dissolved, mercuric acetate in a 4.5 volume percent solution was added at a rate of 5.4 milligrams per gram silver soap to improve whiteness in the developed sheet. This was followed by an addition of 2,2'-methylenebis-(4-methyl-6-tertiarybutyl phenol) at a level of 0.18 grams per gram of silver soap. This "master batch" was then subdivided into smaller batches, which were halidized at levels of from 0.1 to 20 mole percent of available silver. The samples were mixed for 10 minutes after the addition of the halide, which was supplied in the form of mercuric chloride. The silver dispersion was coated as described in Example 1.

A protective/reactive topcoat, as described in Example 1, was applied after drying to each sample at 3.5 mils (89 microns) wet orifice, and dried for 3.5 minutes at 74° C.

The coated samples were exposed to a mercury halide lamp in a 3M Model 261 diazo printer for 20 seconds at maximum lamp intensity through a 0–4 continuous wedge. They were processed for 4 seconds at 132° C. in a heat shoe processor with a nomex fiber nap roller. The sensitometry data of the samples is shown in TABLE III.

TABLE III

| Sample | Mole Percent Halidized | Dmin | Dmax | γ | Speed point |
|---|---|---|---|---|---|
| 6 | 0.1 | .20 | 1.56 | 1.20 | 2.40 |
| 7 | 0.5 | .14 | 1.78 | 1.74 | 2.09 |
| 8 | 1.0 | .14 | 1.75 | 2.74 | 2.38 |
| 9 | 5.0 | .05 | 1.76 | 3.55 | 2.43 |
| 10 | 10.0 | .05 | 1.84 | 3.40 | 2.26 |
| 11 | 20.0 | .04 | 1.89 | 2.23 | 2.15 |

The data of TABLE III show that the decline in mercuric ion levels is associated with rising Dmin values, since the mercuric ion is a powerful antifoggant for the photothermographic systems described in these examples.

Samples number 7–10 were then subjected to a background stability test, to indicate the relative lightfastness of the white background. The unfixed silver halide in previously unexposed areas will preferably remain white during accelerated post-processing light exposure trials, but unstable formulations, reactions with the substrate, and very intense light, heat, or various chemicals agents can deteriorate this whiteness. The accelerated light exposure evaluation was carried out in a constant humidity chamber under a system of daylight fluorescent type tubes, the output of which was adjusted to yield a photometer reading of 2000 footcandles. The chamber humidity was 60 percent relative humidity (RH) and during the test, chamber temperature averaged 27° C. The evaluation showed that sample 10 was severely discolored due to printout silver in the background. Samples 7 and 8 showed little background change, and sample 9 was somewhat discolored. Based on sensitometry and background whiteness stability considerations, the preferred range for chloride halidization was approximately 1 to 5 mole percent of the available silver.

EXAMPLE 4

As an indication of sensitivity of a roomlight handling sheet material, a silver dispersion was prepared as indicated in Example 3, except that the halidization level was 2.3 mole percent of available silver (2.3 mmoles $Cl^-$ per 100 mmoles $Ag^+$) and the developer was 1,1-di(2,4-dimethylphenol)-3-methyl-5,5-dimethylhexane. This was coated upon a titanium dioxide loaded polyester film base, and exposed to light of various sources with the following results:

a. A ten thousand meter candle exposure to tungsten light, when processed for 5 seconds at 132° C., left no visible image.

b. An exposure to a xenon flashtube for $10^{-3}$ seconds, with a log exposure value of 4.55, likewise left no developed image when processed for 5 seconds at 132° C.

c. A two-minute exposure to cool white fluorescent lighting of 40 footcandles produced no increase in developed density.

d. Exposure on a Visual Graphics Corporation (Tamarack, Fla. TPC-30 manual phototypositor, equipped with a high UV output fluorescent type was conducted after two minutes of exposure to cool white fluorescent lighting of 40 footcandles. The lamp exposure for each flash was approximately 0.5 seconds; the exposure was through an alphabet character font to the photothermographic sheet material. After the exposure on the phototypositer (and the initial two-minute roomlight exposure) the sample was processed for 5 seconds at 132° C. Dense, sharp black character images were produced on a white background with a Dmin of 0.07 as measured on a MacBeth RD-100R densitometer (MacBeth Corp.).

The same material, when exposed to a series of xenon flash pulses for a cumulative log exposure of 5.85 through a 0–4 continuous sensitometric wedge, gave the data in TABLE IV:

TABLE IV

| Sample | Dmin | Dmax | | Sensitivity to xonon |
|---|---|---|---|---|
| 12 | .06 | 1.71 | 3.35 | 43,000 ergs/cm$^2$ at 1.6 density |

EXAMPLE 5 a. Silver Source

This Example shows the effect of varying the half-full soap ratio in the silver dispersion layer.

A series of silver dispersion batches were made in accordance with the procedures listed in Example 3, except that the mercuric acetate levels were held at 0.05 percent of the total batch by weight, and the halidization was held constant at two mole percent of available silver.

The topcoat and coating/drying procedures using the phthalazine/4-methylphthalic acid development accelerator were as described in Example 1.

Sensitometry was measured with 0–4 continuous sensitometric wedge, Model 261 diazo printer, for four seconds development at 132° C. The sensitometry data is presented below in TABLE V.

TABLE V

| Sample | Silver: Silver soap weight ratio | Dmin | Dmax | γ | Speed pt. at 0.6 over Dmin |
|---|---|---|---|---|---|
| 13 | 1:7.3 (half soap) | .06 | 1.68 | 1.74 | 2.32 |
| 14 | 1:6.3 | .09 | 1.70 | 2.40 | 2.41 |
| 15 | 1:5.5 | .10 | 1.72 | 3.40 | 2.29 |
| 16 | 1:5.0 | .11 | 1.75 | 4.34 | 2.21 |
| 17 | 1:4.6 | .12 | 1.77 | 5.12 | 2.21 |
| 18 | 1:4.2 (full soap) | .07 | 1.98 | 4.75 | 2.80 |

The data in TABLE V show the effect on sensitometry of increasing the total silver:total silver soap weight ratio. The primary benefit is in maintaining high contrast values not achievable with halp soaps, without resorting to full soaps, which have undesirable properties, as will be shown in TABLE VII below.

The significantly lower contrast of the half soap sample was not recoverable with extended thermal development, as the data of TABLE VI below indicates:

TABLE VI

| Sample | Processing | Dmin | Dmax | γ | Speed point |
|---|---|---|---|---|---|
| Half Soap | 4 sec/132° C. | .06 | 1.68 | 1.74 | 2.32 |
| Half Soap | 5 sec/132° C. | .06 | 1.70 | 1.88 | 2.33 |
| Half Soap | 6 sec/132° C. | .08 | 1.66 | 1.73 | 2.40 |
| Half Soap | 7 sec/132° C. | .09 | 1.65 | 1.98 | 2.20 |
| Half Soap | 8 sec/132° C. | .11 | 1.65 | 1.78 | 2.26 |

b. Light Stability

While the silver image is permanent and not subject to significant fading, the silver salt in white background areas is not fixed, and therefore subject to some darkening and coloration as a reaction to continued light exposure after processing.

This effect was measured with a Hunterlab colorimeter (Hunter Associates Laboratories, Inc.), which measured three parameters before and after a high intensity post-processing light exposure. The parameters measured were lightness, the red-green color coordinate [a] (red is positive, green is negative) and the yellow-blue color coordinate [b] (yellow is positive, blue is negative). Shown below in TABLE VII are the data for the silver soap blends.

Conditions used for the evaluation were as follows:

(1) lighting was 2000 footcandle illumination intensity of daylight fluorescent tubes (2) humidity was 60% RH (3) ambient temperature was approximately 27° C.

(4) exposure time was 2 hours

TABLE VII

| Sample | Silver: Silver soap weight ratio | $L_{initial}$* | $[a]_{initial}$ | $[b]_{initial}$ | $L_{final}$** | $[a]_{final}$ | $[b]_{final}$ |
|---|---|---|---|---|---|---|---|
| 13 | 1:7.3 (half soap) | 90.68 | −1.60 | 2.74 | 89.18 | −.76 | 2.29 |
| 14 | 1:6.3 | 88.33 | −1.60 | 2.04 | 85.75 | −.43 | 1.00 |
| 15 | 1:5.5 | 85.71 | −1.59 | 1.38 | 82.41 | −.27 | .11 |
| 16 | 1:5.0 | 86.90 | −1.60 | 1.61 | 81.27 | .41 | .06 |
| 17 | 1:4.6 | 84.14 | −1.59 | 1.04 | 79.75 | .02 | .06 |
| 18 | 1:4.2 (full soap) | 89.55 | −2.23 | 5.07 | 78.42 | 1.44 | 2.89 |

*$L_{initial}$ is lightness (maximum of 100), initial
**$L_{final}$ is lightness (maximum of 100), final The data in TABLE VII show the relatively high yellowness of full soaps (note [b] values) when used in this formulation. The full soap sample also showed the greatest level of change of all parameters after the two hour light exposure, and the sample showed a particularly large drop in lightness. The half soap was quite stable but had low contrast as was seen in TABLE VI.

c. Haze Level

Minimum haziness of coated product is desired, so that the photosensitive coating does not serve as a source of light scatter.

Haze measurements were made of three photothermographic coatings coated on clear polyester film. The data is presented in TABLE VIII.

TABLE VIII

| Sample | Silver:silver weight soap | Percent haze* |
|---|---|---|
| 19 | 1:7.3 | 8.8 |
| 20 | 1:5 | 4.3 |

TABLE VIII-continued

| Sample | Silver:silver weight soap | Percent haze* |
|---|---|---|
| 22 | 1:4.2 | 4.7 |

*Percent haze is measured as percent of transmitted light scattered in forward direction by a radial angle of more than 2.5°.

The data of TABLE VIII show the effectiveness of full soap/half soap blends in reducing haze.

While all conditions of soap mixtures identified in this example will produce roomlight handleable material in terms of sensitivity, the advantageous properties of high contrast and reduced haze for blends of full soap and half soap, and for full soap were evident. However, the relatively poor stability of full soap may limit its usefulness to proofing applications.

EXAMPLE 6 a. A silver dispersion and protective/reactive topcoat as described in Example 5, sample 15, was coated over a smooth 60-pound (27.2 kg) paper base, which had been previously coated with a solvent based dispersion of rutile titanium dioxide in a cellulose acetate binder. Included in the silver dispersion was a light bleachable photochromic dye. The light bleaching is useful for registering where successive light exposure of type characters had been made, thus providing information to a typositer operator on how to space letters or other information based on the bleached dye image before the sheet material is heat developed to produce a permanent image of reduced silver.

The sheet material was exposed on a prototype Visual Graphics Corp. TPC-30 typositor, producing sharp black character images.

b. Another sample of the silver dispersion and protective/reactive topcoat as described in Example 5, sample 15, was applied to a thermoplastic resin coated paper substrate. This substrate consisted of a paper base, the face side of which was laminated to a hot melt extruded polyethylene resin loaded with approximately 15 percent by weight titanium dioxide. Again very sharp dense black characteris were obtained upon exposure and development.

c. A baryta (barium sulfate) and gelatin overcoated paper substrate containing a UV absorbing optical brightener (Felix Schoeller, Germany) was coated with a silver dispersion and topcoat as described in Example 5, sample 16. When exposed and processed on the Visual Graphics TPC-30, the image sharpness was good.

d. A silver dispersion and topcoat similar to that described in Example 5, sample 15, was coated on a smooth paper base without titanium dioxide loading. Image quality in this case was poor, due to a lack of sharp character definition due to light scatter from the paper substrate and within the coating.

e. When an opaque white voided polyester substrate (Imperial Chemical Industries) was similarly tested, the opacity being derived from microscopic voids rather than titanium dioxide loading, the resultant image was unacceptable in terms of image sharpness. The high opacity of this substrate was not a substitute for antihalation properties provided by a UV absorbing agent.

f. A blended soap formula similar to that described in Example 5, sample 15, was coated onto a 8 percent by weight titanium dioxide sheet, with and without addition of 0.1 percent by weight of Hoechst Hostalux KCB ultraviolet light absorber. When halftone dot pattern and character images made on these materials were viewed at 60 times magnification, an improvement in sharpness was visible in the sample containing the UV absorbing dye.

EXAMPLE 7

This example demonstrates the use of preformed silver chloride.

Homogenized dispersions of half soap and full soap were combined in a glass vessel with toluene. The silver to silver soap ratio was 1:5.5. This was agitated on a mixer, and polyvinyl butyral resin was added at a rate of 1.26 grams resin/gram silver soap. The batch was mixed for 1.5 hours, at which time mercuric acetate was added at a level of 0.06 grams mercuric acetate per gram silver. Following mixing for 15 minutes, 2,2-methylenebis-(4-methyl-6-tertiarybutyl phenol) was added at a level of 0.62 moles per mole silver. Enough preformed silver chloride was added to a portion of the batch to provide 0.04 grams silver chloride per 100 grams of silver dispersion coating media. This preformed silver chloride was specially prepared and was maxtrixed in a solid state media which was predissolved and added to the silver dispersion. The dispersion was then mixed for 15 minutes. The silver dispersion was then coated at 4 mils (102 microns) wet orifice over opaque titanium dioxide loaded polyester, and the dried for 3.5 minutes at 74° C. The topcoat was applied at 3 mils (76.2 microns) and then dried for 3.5 minutes at 74° C. The topcoat formula was the same as indicated in Example 1, with phthalazine 4-methylphthalic acid as the development accelerator.

In another portion of the batch, the mercuric acetate level was increased to 0.089 grams mercuric acetate per gram silver, then mixed for 10 minutes, and then coated as described above.

The sensitometry data is shown below in TABLE IX is for the samples coated at 0.089 g mercuric acetate per gram of silver.

TABLE IX

| Sample | Exposure time | Dmin | Dmax | γ | Speed Point |
|---|---|---|---|---|---|
| 23 (.04 grams AgCl | 1.5 sec | .08 | 1.73 | 2.59 | 2.19 |
| 24 (preformed) per | 1.7 sec | .10 | 1.74 | 2.67 | 2.21 |
| 25 100 grams silver | 1.9 sec | .11 | 1.72 | 2.54 | 2.19 |
| 26 coating dispersion) | 2.1 | .11 | 1.74 | 2.90 | 2.14 |

*Sensiometry - 3M hot roll processor (133° C.) and Model 261 Mercury vapor lamp diazo printer, 20 sec. exposure at maximum intensity with 0–4 continuous wedge.

A sample sheet of the preformed silver chloride halidized material was exposed to cool white fluorescent lighting of 40 footcandle intensity for one minute, then placed under the font of a Visual Graphics Corp. TPC-30 typositor. The sample was exposed and then processed for 1.7 sec. at 133° C. The Dmin was 0.11, read with a MacBeth RD 514 densitometer. Dense, sharp black images were produced, in the same fashion as with the in situ halidized silver dispersions.

EXAMPLE 8

The sensitometry and whiteness stability of dispersions containing varying amounts of polyvinylbutyral B-76 resin and the silver soap were studies.

A silver soap dispersion in toluene and ketones were agitated in a glass vessel. The ratio of full soap to half soap was, in all cases, 2 to 1. The dispersion was divided into five portions. Polyvinyl-butyral resin was added to these mixing dispersions at various levels. After the resin was dissolved, mercuric acetate was added at a 0.045 weight percent level. Following this, the reducing agent, 2,2'-methylenebis-(4-methyl-6-tertiarylbutyl phenol) was added at a level of 0.2 per gram silver soap. The final addition was mercuric chloride, which was added at a level of 5 mg per gram of silver soap. The sample was mixed for 10 minutes, and then coated. The coating and topcoat were as described in Example 1, sample 3.

The samples were processed for 4 sec. at 132° C. after exposure for 20 seconds through a 0–4 continuous wedge on a Model 261 diazo printer. TABLE X shows the sensitometry data at the listed sample resin/silver soap ratios.

TABLE X

| Sample | Weight ratio Resin:Silver soap | Dmin | Dmax | | Speed point |
|---|---|---|---|---|---|
| 27 | 0.6:1 | .12 | 1.78 | 3.53 | 2.39 |
| 28 | 1.0:1 | .12 | 1.71 | 3.93 | 2.34 |
| 29 | 1.3:1 | .09 | 1.71 | 4.37 | 2.22 |
| 30 | 1.7:1 | .07 | 1.71 | 3.88 | 2.39 |
| 31 | 2.0:1 | .05 | 1.66 | 3.25 | 2.44 |

The light stability, or whiteness retention of the dmin areas was tested with a Hunter Lab colorimeter, as described in Example 5. TABLE XI shows the initial and final value data for samples 27–31.

TABLE XI

| Sample | Weight ratio Resin: Silver Soap | $L_i$[a] | $a_i$[b] | $b_i$[c] | $L_f$ | $a_f$ | $b_f$ |
|---|---|---|---|---|---|---|---|
| 27 | 0.6:1 | 82.92 | −1.54 | .74 | 79.45 | −.15 | .04 |
| 28 | 1.0:1 | 84.06 | −1.57 | 1.0 | 80.21 | −.2 | −.09 |
| 29 | 1.3:1 | 86.49 | −1.6 | 1.61 | 80.71 | +.27 | −.08 |
| 30 | 1.7:1 | 89.35 | −1.52 | 2.5 | 82.47 | .80 | +.29 |
| 31 | 2.0:1 | 91.88 | −1.65 | 3.24 | 80.78 | 1.30 | −.20 |

[a]L Lightness (maximum of 100); i is initial and f is final
[b]a red (+ value) or green (− value), i is initial and f is final
[c]b yellow (+ value) or blue (− value), i is initial and f is final The data of TABLES X and XI show the wide range in amounts of polyvinylbutyral resin useful as a binder resin and halidization modifier in the present invention. A preferred range of resin to silver soap ratio which provides desirable sensitometric and stability characteristics in the construction is 1:1 and 1.7:1.

EXAMPLE 9

A blend of homogenized full soap and half soap, with a silver to silver soap ratio of 1:5 was mixed with toluene and agitated in a glass vessel. Polyvinylbutyral resin B-76 was added at a rate of 1.37 g resin per gram silver soap, and mixed until dissolved. Mercuric acetate in methanol was added to provide 4.8 mg mercuric acetate per gram silver soap. The developer, 2,2'-methylenebis-(4-methyl-6-tertiarybutylphenol) was then added at a level of 0.12 grams developer per gram silver soap. Finally the halide was added in sufficient quantity to halidize 1.5 percent of the available silver in the first sample. A second and third sample were similarly prepared, except that bromide ion was introduced (via mercuric bromide) at 2 mole percent and, in the second sample, 4 mole percent of the moles of chloride ion ($Cl^-$) present, both samples representing low level contamination of a non-desirable halogen ion. The three samples were coated, dried, and topcoated as in Example 1 with phthalazine and 4-methylphthalic acid as the development accelerator.

The three samples were exposed for 20 seconds at maximum intensity on a Model 261 diazo printer, and processed with a hot roll processor at 135° C. for 4 seconds. The coatings were made on titanium dioxide loaded polyester film substrate.

TABLE XII

| | SENSITOMETRY | | | |
|---|---|---|---|---|
| Sample | Dmin | Dmax | γ | Speed Point |
| 32 no $Br^-$ added | .08 | 1.66 | 3.84 | 2.28 |
| 33 $Br^-$ 2 mole percent | .09 | 1.69 | 4.09 | 2.10 |
| 34 $Br^-$ 4 mole percent | .10 | 1.71 | 2.91 | 1.93 |

As can be seen, even a low level of 2 mole percent added bromide ion increased speed by 0.18 log units, which represents slightly more than ½f stops.

The three samples were next tested for their respective roomlight handling time versus their tendency to fog. The samples were exposed to cool white fluorescent lighting of 400 footcandle intensity in one minute incremental steps. The materials were tested for 5 min. total, and then processed for 4 second at 135° C. The density values were read with a MacBeth RD-100R densitometer.

TABLE XIII

| | Density at: | | | | | |
|---|---|---|---|---|---|---|
| Sample | Initial | 1 min. | 2 min. | 3 min. | 4 min. | 5 min. |
| 32 No $Br^-$ added | .04 | .04 | .06 | .10 | .17 | .25 |
| 33 $Br^-$ 2 mole percent | .04 | .08 | .11 | .21 | .38 | .67 |
| 34 $Br^-$ 4 mole percent | .04 | .06 | .13 | .30 | .53 | .80 |

The data show that after two minutes roomlight exposure the respective Dmin increases were 0.02, 0.07, and 0.09. Thus, even low levels of bromide ion had a deleterious effect on roomlight handleability.

EXAMPLE 10

Two silver dispersion batches were prepared, one with 1.26 grams polyvinylbutyral resin B-76/gm silver soap present prior to addition of mercuric chloride. The other batch contained 5 mg of polyvinylbutyral resin B-76 per gram silver soap prior to addition of mercuric chloride. In each case, 2 percent by mole ratio of the available silver was halidized. The completed batches were identical in material proportions, differing only in the sequence of additions of components so that halidization of the silver soap would be altered. The batches were coated and topcoated as described iin Example 9.

The sensitometric results and roomlight handling response are listed below in TABLES XIV and XV.

TABLE XIV

| Sensitometry: | Processed 3.7 sec. at 133° C. Exposed 20 sec. on Model 261 | | | | |
|---|---|---|---|---|---|
| Sample | Weight ratio Resin:Silver Soap Before halide addition | Dmin | Dmax | γ | Speed Point |
| 35 | 1.26:1 | .10 | 1.63 | 2.92 | 2.38 |
| 36 | .005:1 | .12 | 1.68 | 3.40 | 1.80 |

Samples were exposed to 40 footcandle coolwhite fluorescent lighting for 90 seconds, then processed for 3–7 seconds at 132° C. The sensitometric data is shown in TABLE XV.

TABLE XV

| Sample | Initial Density | 90 sec. Density |
|---|---|---|
| 35 | .10 | .10 |
| 36 | .11 | .24 |

As the speed point values in TABLE XV indicate, sample 36 is about 2f stops (4 times) more sensitive to the mercury halide lamp than sample 35. TABLE XV also indicates that the roomlight handling time for sample 36 was adversely affected by the low amount of resin present before halide addition.

In the range of 5 to 10 weight percent of the total resin admixed with the silver soap prior to halide addition will ensure reduced photographic sensitivity, however, A third batch prepared with only 0.12 grams polyvinylbutyral B-76 resin/gram silver soap was prepared, coated, and tested for sensitometry and roomlight handling time. The results are shown in TABLE XVI. Exposure was on a Model 261 diazo printer for 20 sec. and it was processed for 3.7 seconds at 132° C.

TABLE XVI

| Sample | Weight ratio Resin:Silver Soap Before halide addition | Dmin | Dmax | γ | Speed-Point |
|---|---|---|---|---|---|
| 37 | 0.12:1 | .08 | 1.79 | 2.7 | 2.45 |

The sample was exposed to 40 footcandle coolwhite fluorescent lighting for 90 sec., then processed for 3.7 sec. at 132° C. The sensitometric data is shown in TABLE XVII.

TABLE XVII

| Sample | Initial Density | 90 sec. Density |
|---|---|---|
| 37 | .08 | .08 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A thermophotographic layered construction comprising:
   a. a transparent or opaque substrate
   b. coated upon one surface of said substrate, a continuous layer of a dry silver dispersion coating, said coating comprisng:
      (1) a blend of organic silver full soap and half soap to provide in said layer a weight ratio of total silver in the coating to silver soap in the range of 1:7 to 1:4.2,
      (2) a polyvinyl acetal resin, said resin to silver soap weight ratio being in the range of 0.6:1 to 2:1, and
   c. a protective/reaction topcoat layer comprising a cellulose acetate resin admixed with an effective amount of a development accelerator, and construction further comprising d. 0.5 to 20 mole percent of halide ion compared to silver in said silver coating layer or said topcoat layer, at least 96 mole percent of said halide ion being chloride ion, and e. an effective amount of at least one antihalation agent incorporated in any of layers, a., b., c., or d., or in a separate layer between said substrate and said silver coating layer, said construction being intrinsically ultraviolet light-responsive and roomlight stable for at least one minute, and capable of forming graphic arts images having a contrast of at least 2.5.

2. The construction of claim 1 wherein said halide ion to silver ratio is 1.0 to 5.0 mole percent.

3. The construction of claim 1 wherein said total silver to silver soap weight ratio in said silver coating is in the range of 1:6 to 1:4.6.

4. The construction of claim 1 wherein said resin to silver soap weight ratio is in the range of 1:1 to 1.7:1.

5. The construction of claim 1 wherein said development accelerator is selected from (a) phthalazinone and (b) phthalizine and 4-methyl phthalic acid.

6. The construction of claim 1 wherein said substrate is opaque and said at least one antihalation agent is titanium dioxide.

7. The construction of claim 1 wherein said substrate is selected from glass, transparent films, opaque films, paper, fabric, and metall foils.

8. A method for preparing a roomlight handleable photothermographic dry silver sheet material which comprises a dry silver dispersion coated on a substrate, halide ion being present in said silver dispersion or in a separate topcoat layer, said sheet material being capable of forming graphic arts images having a contrast of at least 2.5, said method comprisng the steps of:

a. admixing, to prepare said dry silver dispersion coating layer, (1) at least 5 weight percent of the total weight of a polyvinyl acetal resin, and (2) a blend of organic silver full soap and half soap to provide in said layer a total silver to silver soap weight ratio in the range of 1:7 to 1:4.2, said total resin to silver soap weight ratio being in the range of 0.6:1 to 2:1, b. adding subsequently and further admixing, when said halide ion is to be present in said silver dispersion, 0.5 to 20 mole percent of halide ion compared to silver in said silver dispersion coating layer, at least 96 mole percent of said halide ion being chloride ion, or providing said halide ion in said separate topcoat layer, c. coating said dispersion on said substrate, and d. incorporating an effective amount of at least one antihalation agent in at least one of said silver dispersion layer, said substrate, said topcoat layer, or in a separate layer between said substrate and said silver dispersion layer.

* * * * *